United States Patent [19]

DeArmitt

[11] 4,311,256

[45] Jan. 19, 1982

[54] MECHANICAL BREAKUP ACTUATOR

[75] Inventor: Clyde B. DeArmitt, Walnut, Calif.

[73] Assignee: Diamond International Corporation, New York, N.Y.

[21] Appl. No.: 155,664

[22] Filed: Jun. 2, 1980

[51] Int. Cl.[3] ..... B65D 47/34

[52] U.S. Cl. ..... 222/321; 222/402.17

[58] Field of Search ..... 222/394, 341, 340, 321, 222/384, 385, 383, 402.17; 239/333

[56] References Cited

U.S. PATENT DOCUMENTS

| | | |
|---|---|---|
| 1,102,352 | 7/1914 | Peabody et al. . |
| 3,098,610 | 7/1963 | Stram . |
| 3,100,084 | 8/1963 | Biber . |
| 3,188,008 | 6/1965 | Green . |
| 3,785,571 | 1/1974 | Hoening . |
| 3,863,816 | 2/1975 | Focht . |
| 3,881,658 | 5/1975 | Greenebaum et al. . |
| 3,967,765 | 7/1976 | Micallef . |
| 3,990,639 | 11/1976 | Laauwe . |

*Primary Examiner*—Stanley H. Tollberg

*Attorney, Agent, or Firm*—Watson, Cole, Grindle & Watson

[57] ABSTRACT

A valve actuator, usable in pump-type and aerosol fluid product dispensers, includes a one-piece part mounted on the plunger or valve stem of the dispenser for axial reciprocating movement therewith and for rotation relative thereto. The upper end of the plunger or stem has a cylindrical segment covering a cavity surrounding the discharge orifice and a tangentially extending groove so as to form, in a first relative position of the actuator, a swirl chamber and a fluid passage which is open beyond the periphery of the segment so as to establish communication between the outlet of the plunger and the orifice via the fluid passage to thereby effect a fluid spray from the swirl chamber upon plunger reciprocation. In a second relative position of the actuator, the segment uncovers the groove and cavity so as to establish direct communication between the plunger outlet and the discharge orifice so that the fluid is discharged as a solid fluid through the orifice upon plunger reciprocation.

9 Claims, 10 Drawing Figures

MECHANICAL BREAKUP ACTUATOR

BACKGROUND OF THE INVENTION

This invention relates generally to a mechanical breakup actuator for a pump or aerosol dispenser, and more particularly to such actuator which is rotated relative to the plunger into fluid spray and stream positions in which the fluid discharged from the plunger communicates with the discharge orifice respectively via a fluid passage entering a swirl chamber and directly therewith.

Fluid pump actuators of many types have been developed for dispensing product either as a fluid spray, a fluid stream or as both a fluid spray and stream. A fluid spray pattern of some type is generally produced by mechanically breaking up the emitted product prior to discharge through the orifice. A swirling action is imparted to the product to effect such a breakup.

These mechanical breakup actuators, however, typically require relative rotary movement between two or more parts mounted on the plunger or stem, to produce fine mist spray and stream discharges. It would be more advantageous, more economical and less cumbersome if a single-piece actuator mounted on the plunger or stem of the dispenser would produce fine mist spray or stream discharges upon relative rotary movement.

SUMMARY OF THE INVENTION

It is therefore an object of this invention to provide a mechanical breakup actuator for a pump dispenser or for an aerosol valve dispenser wherein the actuator body is mounted on the plunger or stem for reciprocal movement together therewith and for relative rotation into spray discharge or stream discharge positions. The actuator according to the invention is therefore a one-piece member which can be mass produced economically by injection molding and which avoids the critical mating of parts required for prior art breakup actuators.

The present mechanical breakup actuator includes a body having a sleeve with a closed end mounted on the outlet end of the pump plunger for axial movement during plunger reciprocation and for rotation relative thereto. A product discharge orifice extends into the sleeve and is surrounded by a swirl chamber having a tangential fluid inlet passage, both the cavity and the passage being formed between a cylindrical segment of the plunger and the sleeve. The passage is open beyond the periphery of this segment in a first relative position of the actuator so that, during plunger reciprocation in this first position, communication is established between the orifice and the product emitted through the plunger only via the fluid passage to thereby effect a fine mist spray through the orifice as it is given a swirl in the swirl chamber. In a second relative position of the actuator, the plunger segment lies in a completely uncovered position relative to the discharge orifice to thereby establish direct communication between the orifice and the product emitting from the plunger during plunger reciprocation so as to effect a solid stream discharge of product through the orifice.

The segment may be formed as having opposite ends defining stop shoulders for limiting the actuator in its first and second positions upon abutting engagement respectively with a stop element inwardly from an inner surface of the sleeve.

Other objects, advantages and novel features of the invention will become more apparent from the following detailed description of the invention when taken in conjunction with the accompanying drawings.

DETAILED DESCRIPTION OF THE INVENTION

Figure 4:
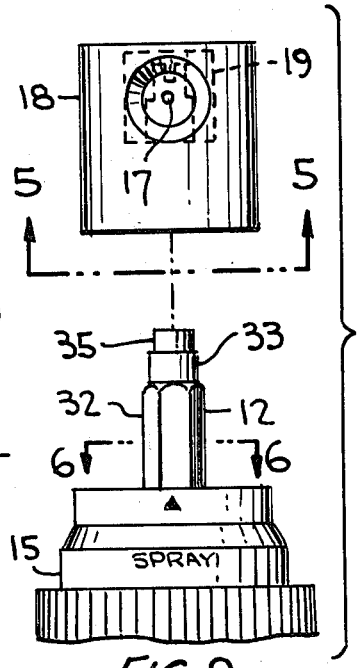
FIG. 4 is an expanded view similar to FIG. 1, with part of the pump broken away for clarity, and showing the pump plunger in full view.

Turning now to the drawings wherein like reference characters refer to like and corresponding parts throughout the several views, the mechanical breakup actuator, generally designated 10, according to the invention is described in relation to a pressure build-up pump dispenser which generally includes a hollow plunger 12 (FIG. 4) adapted to reciprocate along its axis for expelling the product from the container through an upper outlet end. As will be seen, however, the invention is not limited for use in mechanically breaking up product expelled from a pump-type dispenser, but is likewise readily available for breaking up product expelled through the stem of an aerosol dispenser. In such case, actuator 10 will be mounted on the stem in the same manner so as to achieve the same purpose as described with reference to a pump dispenser as hereinafter described.

Figure 1:
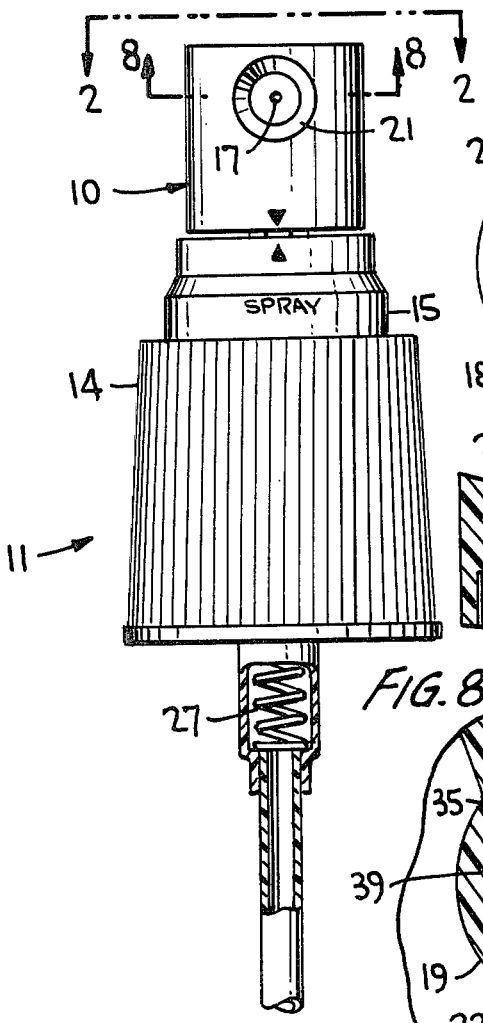
FIG. 1 is a side elevational view of the actuator according to the invention, shown in a spray position, and mounted on a closure cap associated with a pressure build-up pump with which the present invention may be utilized.
Figure 5:
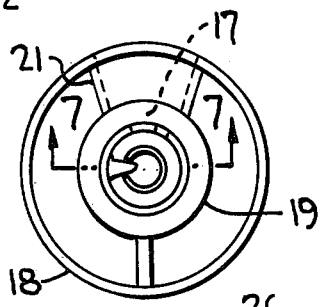
FIG. 5 is a plan view of the underside of the actuator taking substantially along line 5—5 of FIG. 4.

Dispenser 11 includes an internally threaded closure cap 14 for mounting the dispenser on a bottle or container (not shown) of product to be dispensed. The cap has an upstanding collar 15 which may have SPRAY and STREAM indicia imprinted on opposite sides thereof (FIGS. 1 and 3), and upwardly extending arrows associated therewith. And, actuator 10 may have downwardly extending arrows applied on opposite sides thereof for aiding the user in selecting a spray or a solid stream discharge of fluid product. An upper wall 16 of the actuator may have an arrow applied thereto indicating the location of a discharge orifice 17, together with curved arrows showing the directions in which the actuator may be rotated.

The actuator includes an outer cylindrical wall 18 depending from its upper wall 16, as well as an inner sleeve 19 likewise depending from wall 16. Discharge orifice 17 extends through this sleeve and is surrounded by a conical wall 21 extending between wall 18 and sleeve 19.

Figure 7:
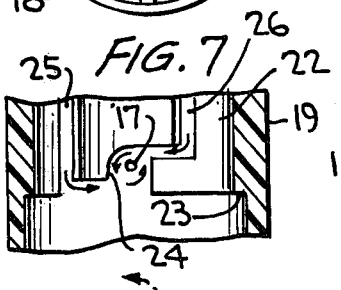
FIG. 7 is an enlarged sectional view of the actuator sleeve taken substantially along line 7—7 of FIG. 5.
Figure 10:
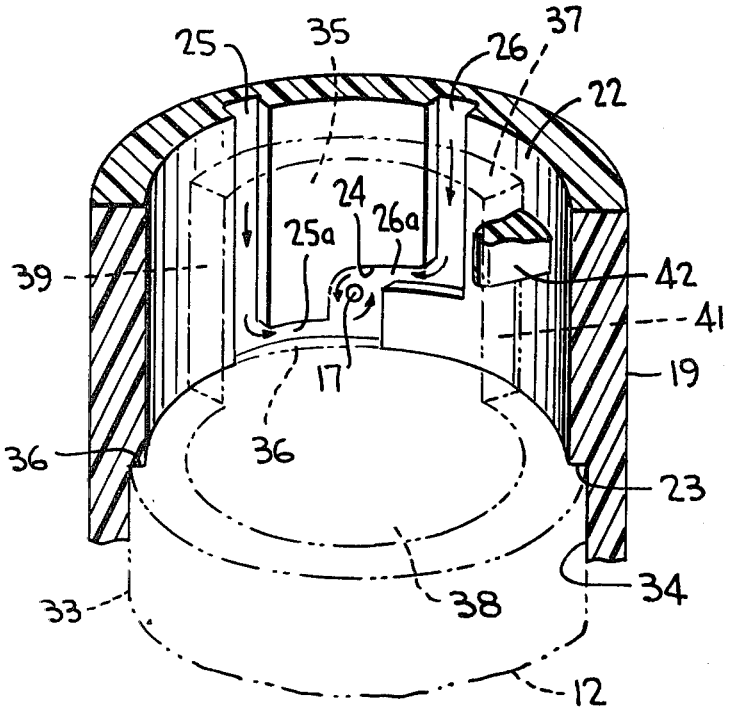
FIG. 10 is an enlarged perspective view, in section, of the actuator sleeve in an upright position and in a fluid spray discharge position relative to the plunger shown in phantom outline.

An upper thickened portion 22 of the sleeve has a smaller inner diameter as compared to the lower portion thereof, the interface between inner diameters presenting an annular shoulder 23 as most clearly shown in FIGS. 7 and 10. An inwardly open cavity 24 is formed in this thickened portion 22 and surrounds discharge orifice 17. And, a pair of inwardly open grooves 25, 26 are likewise formed in thickened portion 22 on opposite sides of the orifice and extend substantially from the upper closed end of the sleeve and tangentially into opposite sides of cavity 24 via spaced apart groove legs **25*a*, 26*a***.

The plunger is mounted within the pump for axial reciprocating movement in any normal manner as against the bias of a return spring 27. The actuator is mounted on the plunger for reciprocating movement therewith as finger pressure is exerted against upper wall 16 to thereby depress the plunger for operating the pump in a well-known manner. The outer diameter of outer wall 18 of the actuator is slightly less than the inner diameter of collar 15 so as to avoid any interference therewith during plunger reciprocation.

Figure 6:
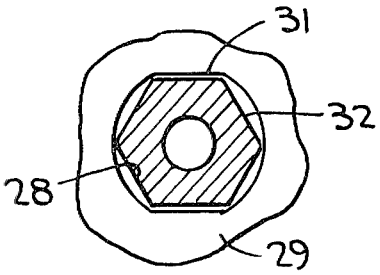
FIG. 6 is a sectional view of the plunger in its relation to a flattened opening through which the plunger extends for preventing relative plunger rotation.

The plunger extends outwardly of the pump through an opening 28 provided in an upper wall 29 (FIG. 6). This opening is provided with at least one flat edge 31, and base 32 of the plunger is provided with at least one corresponding flat edge on its outer periphery. In FIG. 6, it can be seen that an opposed pair of flat edges 31 is formed in opening 28 with the outer periphery of the plunger base being of hexagonal shape. The plunger is thereby keyed to the pump to prevent its rotation while rotating the actuator into the stream and spray positions.

Adjacent its base 32, the plunger has a smooth section 33 of an outer diameter substantially equal to inner diameter 34 of the sleeve lying below shoulder 23 (see FIG. 10). And, the plunger terminates in a cylindrical segment 35 which extends outwardly of section 33 and has an outer diameter which presents an arcuate surface portion substantially equal to the inner diameter of portion 22. The difference in outer diameters between section 33 and segment 35 presents an arcuate shoulder 36. Thus, when the actuator is assembled in place, the sleeve is pressed down over the plunger until shoulder 23 abuts against shoulder 36. Inner diameter 34 of the sleeve is therefore in snug engagement with section 33 of the plunger, and the inner surface of upper portion 22 is in snug engagement with segment 35. And, since the plunger is keyed against rotation relative to the pump, the actuator is capable of being rotated or turned relative to the plunger between the FIGS. 8 and 10 position and the FIG. 9 position. In the first of these positions, shown most clearly in FIG. 10, segment 35 is of a sufficient height and width so as to cover cavity 24 and grooves 25, 26 except that the grooves remain open and uncovered beyond upper end 37 of the segment. Thus, in the covered position of FIG. 10, the grooves and the cavity respectively function as fluid passages 25, 26 and a swirl chamber 24. And, shoulder 36 defines a lower wall of passage 25 and swirl chamber 24. In order to simplify the formation of the grooves and cavity during manufacture, groove 25, its leg **25*a* and the cavity may be merged into inner diameter 34, so that shoulder 36 forms a wall for this groove and cavity as aforedescribed. Otherwise, groove 25, its leg 25*a* and the cavity may be entirely formed in thickened portion 22**.

The fluid passages and swirl chamber are thus formed between sleeve 19 and segment 35 to thereby establish communication between outlet 38 of the plunger through which fluid product emerges and orifice 17 via only fluid passages 25 and 26. Thus, upon plunger reciprocation in the first actuator position of FIG. 10, the fluid product emerging through outlet 38 enters passages 25 and 26 at the uncovered open ends thereof and flows in the direction of the arrows. As the fluid product enters swirl chamber 24 through spaced apart tangential legs **25*a*, 26*a*, it is caused to swirl as it is forced through the actuator so that the combined motions of swirling and axial flow through discharge orifice 17** provide a mechanical breakup of the product and the consequent production of a spray pattern.

Segment 35 has opposing side edges defining stop shoulders 39 and 41, and a stop element 42 extends radially inwardly from upper portion 22 for limiting the actuator in its first relative position of FIG. 10 as shoulder 41 abuts against one side of the stop element. The SPRAY indicia and the mating arrows associated therewith, an aforedescribed, are of course correlated with the FIG. 10 spray position so that the operator may simply rotate the actuator into this position and, upon finger depression thereof, effect a fluid spray of product from the container through the plunger.

Figure 2:
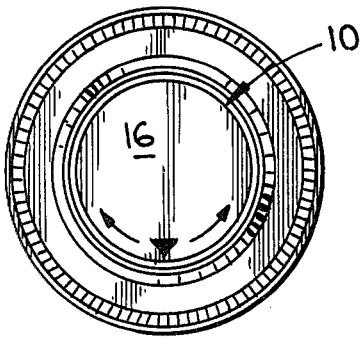
FIG. 2 is a top plan view of the FIG. 1 pump and actuator.
Figure 3:
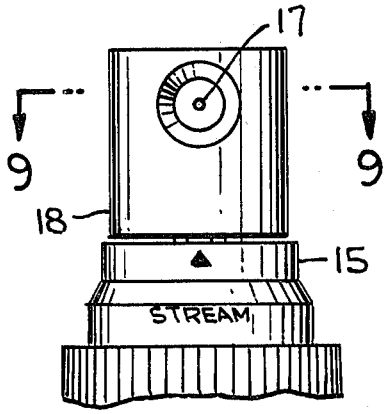
FIG. 3 is a view similar to FIG. 1, with part of the pump broken away for clarity, and showing the actuator rotated into a stream discharge position.
Figure 8:
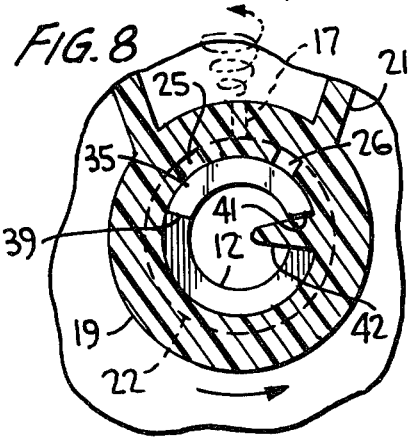
FIG. 8 is an enlarged sectional view of the actuator sleeve shown rotated into a fluid spray position relative to the plunger, and taken substantially along line 8—8 of FIG. 1.
Figure 9:
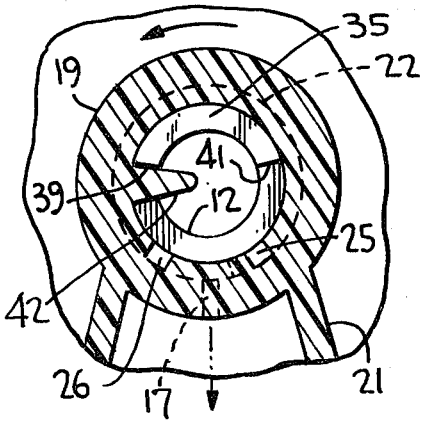
FIG. 9 is an enlarged sectional view taken substantially along line 9—9 of FIG. 3 and showing the actuator rotated into a stream discharge position relative to the plunger.

Upon rotation of the actuator relative to the plunger from the first relative position of FIG. 8 to the second relative position of FIG. 9, in the direction of the arrow, it can be seen that segment 35 is now disposed opposite the discharge orifice and is limited in this position as stop shoulder 39 thereof abuts against an opposite side of stop element 42. The discharge orifice, cavity 24 and grooves 25, 26 are now completely uncovered by segment 35 whereupon direct communication is established between outlet 38 of the plunger and orifice 17. Thus, fluid product is discharged through the orifice 17 as a fluid stream upon plunger reciprocation in the FIG. 9 position of the actuator. Again, the STREAM indicia and the mating arrows of FIG. 3 are correlated with the FIG. 9 position as an aid to the operator in selecting the solid stream discharge. In the FIG. 9 position, fluid product rushes directly through orifice 17 and is emitted therefrom in the form of a solid stream since the function of the tangential groove legs and the swirl chamber is inhibited when uncovered by segment 35.

From the foregoing, it can be seen that a simple and economical yet highly effective mechanical breakup actuator has been devised for a dispenser of either a pump or an aerosol type which is of simple one-piece construction capable of being mass produced by ejection molding or the like. Arcuate segment 35 at the tip of the plunger functions to respectively cover and uncover the cavity and grooves in the FIG. 8 and FIG. 9 relative positions of the actuator. In lieu of a segment 35 which may be formed simply by the removal of a portion of the tip of the plunger beyond section 33, an arcuate segment may be formed by flattening a peripheral wall portion of the tip beyond section 33 without departing from the scope of the invention. However, stop shoulders 39, 41 would be thereby eliminated together with stop element 42, although such a plunger tip design would function the same as segment 35 described above.

Obviously, many other modifications and variations of the present invention are made possible in the light of the above teachings. It is therefore to be understood that within the scope of the appended claims the invention may be practiced otherwise than as specifically described.

What is claimed is:

1. A mechanical breakup actuator for a container of fluid product, including a plunger through which the product is discharged upon reciprocation of the plunger, the actuator being mounted on said plunger for axial movement together therewith to effect the reciprocation and being mounted for rotation relative thereto, the actuator having a cylindrical sleeve closed at one end and snuggly engaging said plunger at an end thereof, the actuator having a product discharge orifice communicating with the interior of said sleeve, an inner surface of said sleeve having a cavity formed therein surrounding said orifice, said inner surface further having at least one groove formed therein extending tangentially into said cavity from said closed end of said sleeve, said plunger having a surface portion of a predetermined extent which covers said cavity and said groove in a first relative position of the actuator so as to respectively define a swirl chamber and a fluid passage, an outer end of said surface portion being spaced from said closed end of said sleeve, communication between said end of said plunger and said orifice in said first position thereby being established only via said passage, whereby the product is discharged through said orifice as a spray upon plunger reciprocation in said first position of the actuator, said surface portion uncovering said depression and said groove in a second relative position of the actuator to thereby establish direct communication between said end of said plunger and said orifice, whereby the product is discharged through said orifice as a stream upon plunger reciprocation in said second position of the actuator.

2. The actuator according to claim 1, wherein opposite ends of said surface portion define stop shoulders, a stop element extending inwardly from said inner surface being disposed adjacent one of said shoulders, engagement between said one shoulder and one side of stop element limiting the actuator in said first position, and engagement between the other of said shoulders and the opposite side of said stop element limiting the actuator in said second position.

3. The actuator according to claim 1 or 2, wherein said plunger and said inner surface have interengaging shoulders for maintaining said outer end of said surface portion spaced from said closed end of said sleeve.

4. The actuator according to claim 1 or 2, wherein said inner surface has two grooves formed therein disposed on opposite sides of said orifice and extending from said closed end of said sleeve and tangentially into said cavity at spaced apart locations, said surface portion covering said grooves in said first position so as to define two fluid passages.

5. A mechanical breakup actuator for a container of fluid product which includes a plunger through which the product is discharged upon plunger reciprocation, the actuator comprising a body having a cylindrical sleeve closed at one end and being mounted on an end of said plunger for axial reciprocating movement therewith and for rotation relative thereto, said body having a product discharge orifice extending into said sleeve, said plunger having a cylindrical segment bearing against an inner surface of said sleeve, said segment and said sleeve having formed therebetween in a first relative position of said body, a swirl chamber surrounding said orifice and a fluid passage open beyond said segment and extending tangentially into said chamber, communication between said end of said plunger and said orifice being established only via said passage, whereby the product is discharged through said orifice as a fluid spray upon plunger reciprocation in said first position of said body, said segment lying in a completely uncovered position relative to said orifice with said body rotated to a second relative position spaced radially from said first position to thereby establish direct communication between said end of said plunger and said orifice, whereby the product is discharged through said orifice as a fluid stream upon plunger reciprocation in said second position of said body.

6. The actuator according to claim 5, wherein opposite ends of said segment portion define stop shoulders, a stop element extending inwardly from said inner surface being disposed adjacent one of said shoulders, engagement between the other of said shoulders and the opposite side of said stop element limiting the actuator in said second position.

7. The actuator according to claim 5 or 6, wherein said segment and said sleeve have formed therebetween, in said first position, a pair of fluid passages disposed on opposite sides of said orifice and open beyond said segment and extending tangentially into said chamber at spaced apart locations.

8. The actuator according to claim 5 or 6, wherein said swirl chamber and said passages are defined respectively by a cavity and a groove formed in an inner surface of said sleeve and covered by said segment in said first position.

9. The actuator according to claim 7, wherein said swirl chamber and said passages are defined respectively by a cavity and grooves formed in an inner surface of said sleeve and covered by said segment in said first position.

* * * * *